United States Patent [19]

Linnepe

[11] 3,936,980

[45] Feb. 10, 1976

[54] METHOD OF AND APPARATUS FOR GRINDING WIRE

[75] Inventor: Harald Linnepe, Ludenscheid, Germany

[73] Assignee: Vereinigte Deutsche Metallwerke AG, Frankfurt am Main, Germany

[22] Filed: Aug. 15, 1974

[21] Appl. No.: 497,641

[30] Foreign Application Priority Data

Aug. 16, 1973 Germany ..... 2341437
Mar. 18, 1974 Germany ..... 2412842

[52] U.S. Cl. ..... 51/73 R; 51/90; 51/289 R
[51] Int. Cl.[2] ..... B24B 5/38; B24B 1/00
[58] Field of Search ..... 51/73 R, 75, 79, 90, 281 P, 51/289; 29/33 F, 81 F

[56] References Cited

UNITED STATES PATENTS

| | | | |
|---|---|---|---|
| 1,797,174 | 3/1931 | Matteson | 51/73 R |
| 2,293,923 | 8/1942 | Stewart | 51/73 R |
| 2,497,407 | 2/1950 | Green | 51/289 R X |
| 2,974,056 | 3/1961 | Namenyi-Katz | 51/73 R X |
| 2,975,506 | 3/1961 | Bell | 51/73 R X |
| 3,400,451 | 9/1968 | Pierce | 51/73 R |

*Primary Examiner*—Harold D. Whitehead
*Assistant Examiner*—Nicholas P. Godici
*Attorney, Agent, or Firm*—Karl F. Ross; Herbert Dubno

[57] ABSTRACT

A wire is passed along an axial path through a housing having a frame driven rotatably about the axis of the path. A plurality of angularly equispaced arms mounted on shafts parallel to the axis each carry a respective grinding member having a central bore which is aligned with the axis so that the inner surface of the bore is the active grinding surface effective on the outer surface of the wire. The grinding members are rotated and/or the wire is rotated for grinding action across the displacement direction.

4 Claims, 3 Drawing Figures

METHOD OF AND APPARATUS FOR GRINDING WIRE

FIELD OF THE INVENTION

This invention relates to a method of and an apparatus for grinding wire, tubes, rods, strip or other elongated workpieces by means of rotating grinding members.

BACKGROUND OF THE INVENTION

In the production of elongated elements by rolling, drawing, and similar operations, interstage annealing is often required which produces a more or less strong scaling or at least oxidation of the surfaces. Such scale layers must be removed before the further processing. Chemical methods may be used for this purpose but involve difficulties in connection with the disposal of the pickling agents which have been employed and which in most cases are liquid. For this reason, descaling by means of wire-grinding machines has been increasingly adopted because it involves less potential for pollution of the environment.

Unlike elements of short length, wires, rods, strip material and the like cannot be ground by fixing them, e.g. in a lathe, rotating them, and machining them with a stationary or also rotating grinding member to which an axial feed is imparted. Wires and the like must be axially advanced as they are ground and in that operation their three-dimensional relation to the grinding member must be controlled by guides. To provide for a descaling over the entire outer surface of the wire, care must also be taken to create relative rotation between the axially advancing wire and the grinding member.

According to one proposal, this is accomplished in an apparatus for grinding round stock which comprises a stationary supporting frame carrying a system or support which rotates about an axis that is parallel to the direction of travel of the stock to be ground, and at least two rotating wheels mounted on the rotating system.

In that apparatus the rotating grinding members are offset by 180° from each other with respect to the axis of rotation of the system so that the stock to be machined is ground on two mutually opposite lines of contact at the same time. Such machining is possible only if guide means are provided to hold the stock to be machined in the correct position relative to the grinding members. Such guide means must be provided close to the point where grinding is performed so that it can take up the reaction forces which are due to the grinding operation. On the other hand, in apparatus comprising a pair of simultaneously operating grinding wheels the space which is available for such guide means is very small, particularly when it is desired to grind material which is relatively small in cross-section. In addition the adjustment for the grinding members relative to each other and to the guide means involves a considerable expenditure because economic grinding can be expected only if very exact adjustment is employed.

Objects of the Invention

It is therefore an object of the present invention to provide an improved method of and apparatus for grinding an elongated workpiece such as a wire.

Another object is the provision of an improved grinding system which can machine workpieces of different diameters without requiring complicated resetting and which is relative simple.

Summary of the Invention

These objects are attained according to the present invention in a system wherein the stock to be ground is axially and rectilinearly guided through a central opening of an annular grinding member and is advanced so that the surface of the grinding member which defines the opening is used as an active grinding surface.

In accordance with the invention, the outside peripheral surface or end face of a rotating grinding member is not used as the active grinding surface. A grinding member having the central bore is, on the contrary, mounted in such a manner that the central bore usually employed for mounting the member, more specifically, the surface defining said bore, can be used for grinding.

According to a further feature of the method according to the invention, a revolving relating movement takes place between the stock to be ground and the rotating grinding member. This may be effected by rotating the stock to be ground substantially about its own longitudinal axis or by rotating the grinding member about the stock to be ground.

The stock to be ground is suitably guided and advanced through a plurality of rotating grinding members arranged in succession.

The apparatus for carrying out the method according to the invention comprises a frame which is rotatably mounted in a stationary machine frame by means of hollow journals, at least one driven shaft which is eccentrically mounted in the frame on an axis parallel to the axis of rotation of the frame, at least one arm which is pivoted on the shaft, a grinding member which is rotatably mounted on the arm in an outer bearing and has a central cylindrical opening substantially coinciding with the axis of rotation of the frame, drive means for the grinding member or members consisting of a motor, a first V-belt drive, a gear train, and one or more second V-belt drives, independent drive means for the frame consisting of a motor and a V-belt drive, and means known per se for feeding and discharging the stock to be ground.

The rotatably mounted frame consists suitably of a drum having journals on its opposite ends.

According to another feature of the apparatus according to the invention, the means for driving the frame is connected to one journal and the gear for driving the grinding members is rotatably mounted on the other journal and connected to a V-belt pulley.

In accordance with another feature of this invention the driven shaft carries a gear on its end which protrudes from the end face of the frame and this gear is in mesh with a gear that is rotatably mounted on the journal.

At least two driven shafts are mounted in the frame and are angularly equispaced about the axis.

A plurality of grinding members together with associated V-belt drives are arranged according to the invention on each of these shafts.

To enable an operator to reach into the apparatus for instance to collect the material removed by grinding, part of the stationary machine frame consists of a hinged covering section of a housing shell.

BRIEF DESCRIPTION OF THE DRAWING

The above and other objects, features, and advantages of the present invention will become more readily apparent from the following description, reference being made to the accompanying drawing in which.

SPECIFIC DESCRIPTION

Figures 1, 1A, 2:
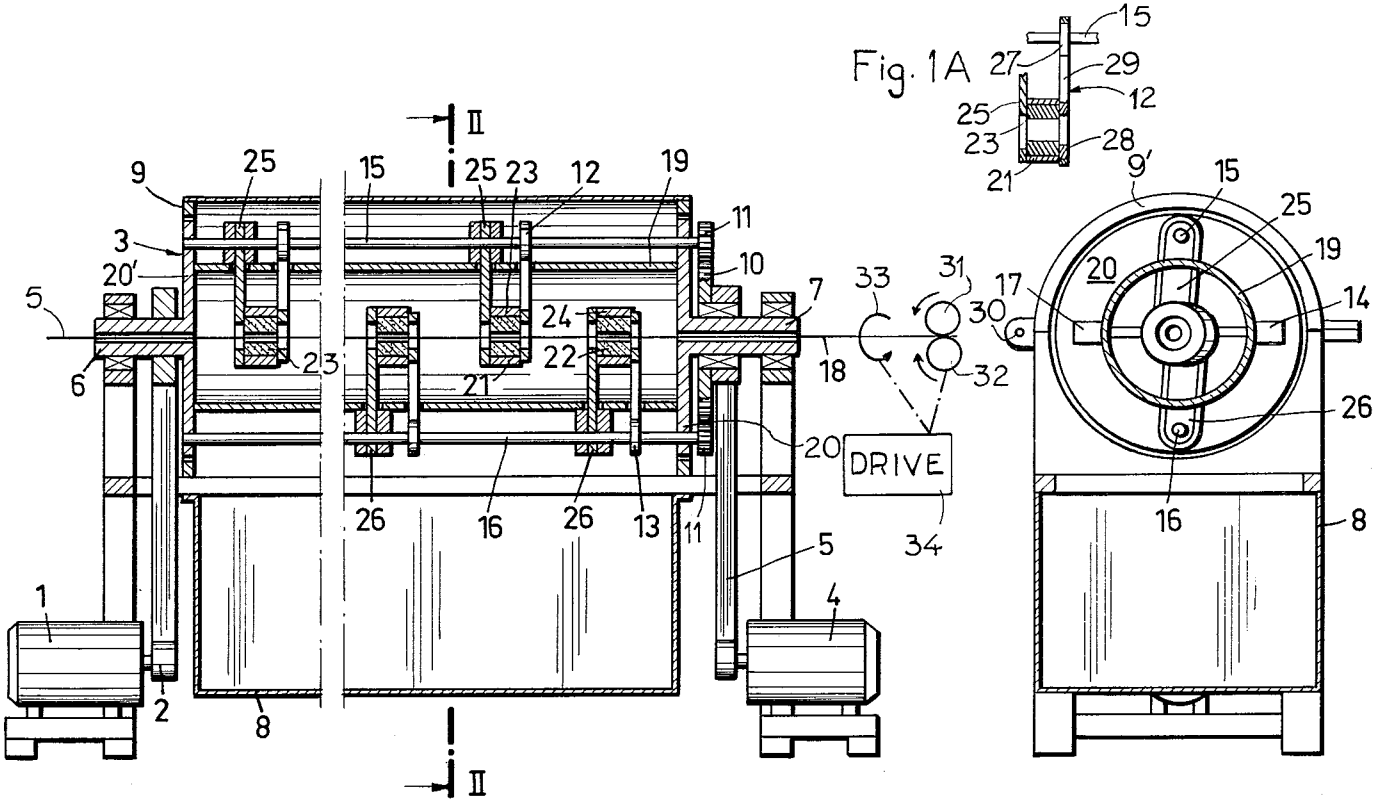
FIG. 1 is an axial section partly in diagrammatic form through the apparatus according to the invention.
FIG. 1A is a large-scale view of a detail of FIG. 1.
FIG. 2 is a section taken along line II — II of FIG. 1.

In the apparatus according to the invention shown in FIGS. 1 and 2, the stock to be ground is advanced along an axial path indicated at 18. A frame 3 is mounted in a stationary machine frame 8, 9 by means of hollow journals 6 and 7 centered on and rotatable about the axis defined by said path. The frame consists essentially of a tubular element 19 passing axially between two circular end faces 20' and 20'' which are externally connected to the journals 6 and 7 and internally to the tubular member 19. Two axle shafts 15 and 16 are rotatably mounted in the circular end faces and are disposed outside the tubular element 19 parallel to and equispaced radially from the axis of rotation of the frame but parallel to said axis. Pinions 11 are mounted on the ends of these shafts 15 and 16 outside the circular end face 20'' and are in mesh with a large gear 10 which is rotatably mounted on the journal 7. A motor 4 and a V-belt drive 5, rotates the gear 10 so that the shafts 15 and 16 can thus be driven independently of the rotary movement of the frame 3, to which rotation is imparted by a motor 1 and V-belt drive 2 connected to the journal 6. Arms 25 and 26 are pivoted to the tubular member 19 so that their pivot axes coincide with the axis of the driven shafts 1 and 16, respectively. These arms extend toward the path 18 of the apparatus and carry at their free inner ends bearings 23 and 24 pivotally movable to a position in which they are centered on said axis. Annular grinding stones or members 21, 22 are rotatably mounted in the bearings 23 and 24. Rotation is imparted to these grinding members by the driven shafts 15 and 16 and V-belt drives 12 and 13.

FIG. 1A shows the drive 12, which is identical to the drive 13. A belt 29 is spanned between a pulley 27 on the shaft 15 and a pulley bolted to the axial end face of the cylindrically annular grinding stone 23 which itself is rotatable within the bearing 21. In this manner rotation of the shaft 15 by the motor 4 also rotates the respective stones 23 about the axis 18.

In the apparatus according to the invention, the pivoted carriers for the grinding members and centrifugal forces generally ensure that a sufficiently high pressure will be applied between the stock to be ground and the grinding members. If the pressure applied is too small or too large, devices 14 and 17 may be used to turn the arms 25 and 26 through a predetermined angle from the radial position or to urge them with a predetermined force against the stock to be ground which moves through the openings in the stones.

More than four grinding members can be used in the apparatus according to the invention. The driven shafts 15 and 16 arranged in the circular end faces need not be angularly offset by 180°; any desired number of grinding members with a spacing may be used. For instance, for three grinding members, three driven shafts would be provided, offset from one another by 120°.

As is indicated in FIG. 2, the upper portion 9' of the machine frame 9 is suitably hinged at 30 to facilitate access to the interior of the apparatus.

When the apparatus according to the invention is used, e.g. for grinding, the number of grinding members, their axial extent, the speed of the frame and the speed of advance of the wire are matched so that the surface of the wire is ground at least once in sufficient depth. The adjustment may also be such that the surface is ground several times. Suitable grinding members may be employed for rough and finish grinding operations.

The stock S is pulled through the machine by a pair of rollers 31 and 32 which can also be rotated about the axis 18 as shown by arrow 33 by means of a drive indicated schematically at 34. The feed speed and rotation direction are set depending on the stock type. Advantageously the stock S is rotated in one sense and the grinding stones 22 and 23 in the opposite sense.

I claim:

1. An apparatus for grinding wire comprising:

means for displacing said wire along a straight path;

a frame journaled for rotation about an axis lying along said path;

an arm swingably mounted on said frame about a pivot offset from said axis;

a grinding body formed with a bore traversed by said wire and having an abrasive wall, said grinding body being rotatably mounted on said arm;

first driving means operatively connected with said frame for rotating same about said axis; and second driving means operatively connected with said grinding body for rotating same to abrade the exterior surface of said wire against said wall.

2. The apparatus defined in claim 1, wherein a plurality of such grinding members are carried on said frame and angularly equispaced about said axis.

3. The apparatus defined in claim 1 wherein each of said drive means includes a motor and a V-belt drive.

4. A method of grinding the outer surface of an elongated workpiece, comprising the steps of:

displacing said workpiece longitudinally through a bore having an abrasive wall in an annular grinding member;

swinging said annular grinding member against said workpiece about an orbital axis parallel to but spaced from the axis of said workpiece;

confining said workpiece to a straight line path during said displacement and through said bore;

rotating said orbital axis about said axis of said workpiece; and concomitantly rotating said grinding member about said workpiece with said wall of said bore in contact with the outer surface of said workpiece whereby the rotation of said orbital axis about said workpiece brings said abrasive wall into contact with substantially the entire periphery of said workpiece.

* * * * *